US006463913B1

(12) United States Patent
Kotwicki et al.

(10) Patent No.: US 6,463,913 B1
(45) Date of Patent: Oct. 15, 2002

(54) FUEL CONTROL SYSTEM

(75) Inventors: Allan Joseph Kotwicki, Williamsburg; Paul A. Crosby, Ann Arbor; Ross Dykstra Pursifull, Dearborn, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 17 days.

(21) Appl. No.: 09/607,249

(22) Filed: Jun. 30, 2000

(51) Int. Cl.[7] ..... F02D 41/00

(52) U.S. Cl. ..... 123/488; 701/115; 701/105; 123/478; 123/480; 123/436

(58) Field of Search ..... 123/488, 478, 123/435, 436, 480, 479; 701/101, 102, 105, 115

(56) References Cited

U.S. PATENT DOCUMENTS 3,673,989 A * 7/1972 Aono et al. ..... 123/491
3,969,614 A 7/1976 Moyer et al.
4,176,629 A * 12/1979 Kawai et al. ..... 123/406.47
4,245,604 A * 1/1981 Lahiff ..... 123/478
4,266,275 A * 5/1981 Marchak ..... 701/110
4,404,946 A 9/1983 Hoard et al.
4,495,926 A * 1/1985 Kobayashi et al. ..... 123/486
4,986,243 A * 1/1991 Weissler, II et al. .... 123/406.65
5,255,655 A * 10/1993 Denz et al. ..... 123/479
5,282,449 A * 2/1994 Takahashi et al. ..... 123/350
5,497,329 A * 3/1996 Tang ..... 701/104
5,988,149 A 11/1999 Gates

FOREIGN PATENT DOCUMENTS

WO WO 90/15921 * 12/1990 ..... F02D/41/10

* cited by examiner

*Primary Examiner*—John Kwon
*Assistant Examiner*—Hieu T. Vo
(74) *Attorney, Agent, or Firm*—Allan J. Lippa; John D. Russell

(57) ABSTRACT

A fuel control method uses a MAP sensor output that is encoded to render fueling computations insensitive to microprocessor clock accuracy. The signal output of the MAP sensor is encoded as a pulse width modulated signal, the cylinder air mass is calculated as a function of the encoded MAP signal and the engine is fueled according to the calculated cylinder air mass. By using the same time scale to decode the pulse width of the MAP PWM signal as is used to time injector duration, the time scale becomes irrelevant to the actual fuel/air ratio attained.

15 Claims, 3 Drawing Sheets

FUEL CONTROL SYSTEM

TECHNICAL FIELD

This invention relates to fuel control systems and, more particularly, to a system that is insensitive to the timing inaccuracy of a low cost microcontroller timing source.

BACKGROUND ART

The vast majority of engine fuel control systems are based on either manifold absolute pressure (MAP), mass air flow (MAF), or MAP+MAF. The basic objective is to measure air flow or air flow rate into the engine and meter a corresponding fuel amount to achieve either a cumulative or instantaneous fuel/air composition.

Fueling error has disadvantageous consequences for emissions control. One potential source of error is the timing sources in the microcontroller. Fuel amount injected is controlled by the time the fuel injector is open. Thus, time measurement influences fueling amount. A clock source that is 1% slower than design intent results in usage of approximately 1% more fuel than intended.

Historically, the manner in which this problem is addressed is to provide the Powertrain Control Module (PCM) with a high-accuracy, high-cost timing source, using a quartz crystal instead of a relatively low accuracy, low-cost timing sources using a ceramic resonator.

DISCLOSURE OF INVENTION

In accordance with the present invention, a fuel control method is provided that uses a MAP sensor output that is encoding to render fueling computations insensitive to microprocessor clock accuracy. More particularly, the signal output of the MAP sensor is encoded as a pulse width modulated signal, the cylinder air mass is calculated as a function of the encoded MAP signal and the engine is fueled according to the calculated cylinder air mass. Because the same time scale is used to decode the pulse width of the MAP PWM signal as is used to time injector duration, the time scale becomes irrelevant to the actual fuel/air ratio attained. A further improvement may be achieved by shaping either the fuel injector transfer function (fuel delivered versus injector driver on-time) or the MAP transfer function (MAP versus pulse width). Preferably, the MAP sensor's PWM encoding is arranged such that the period is affine with MAP, meaning high MAP, long period, and low MAP, short period. Period encoding is of interest for capacitor-based pressure sensors because a change in frequency is a common way to sense capacitance change.

BEST MODE FOR CARRYING OUT THE INVENTION

Figure 1:
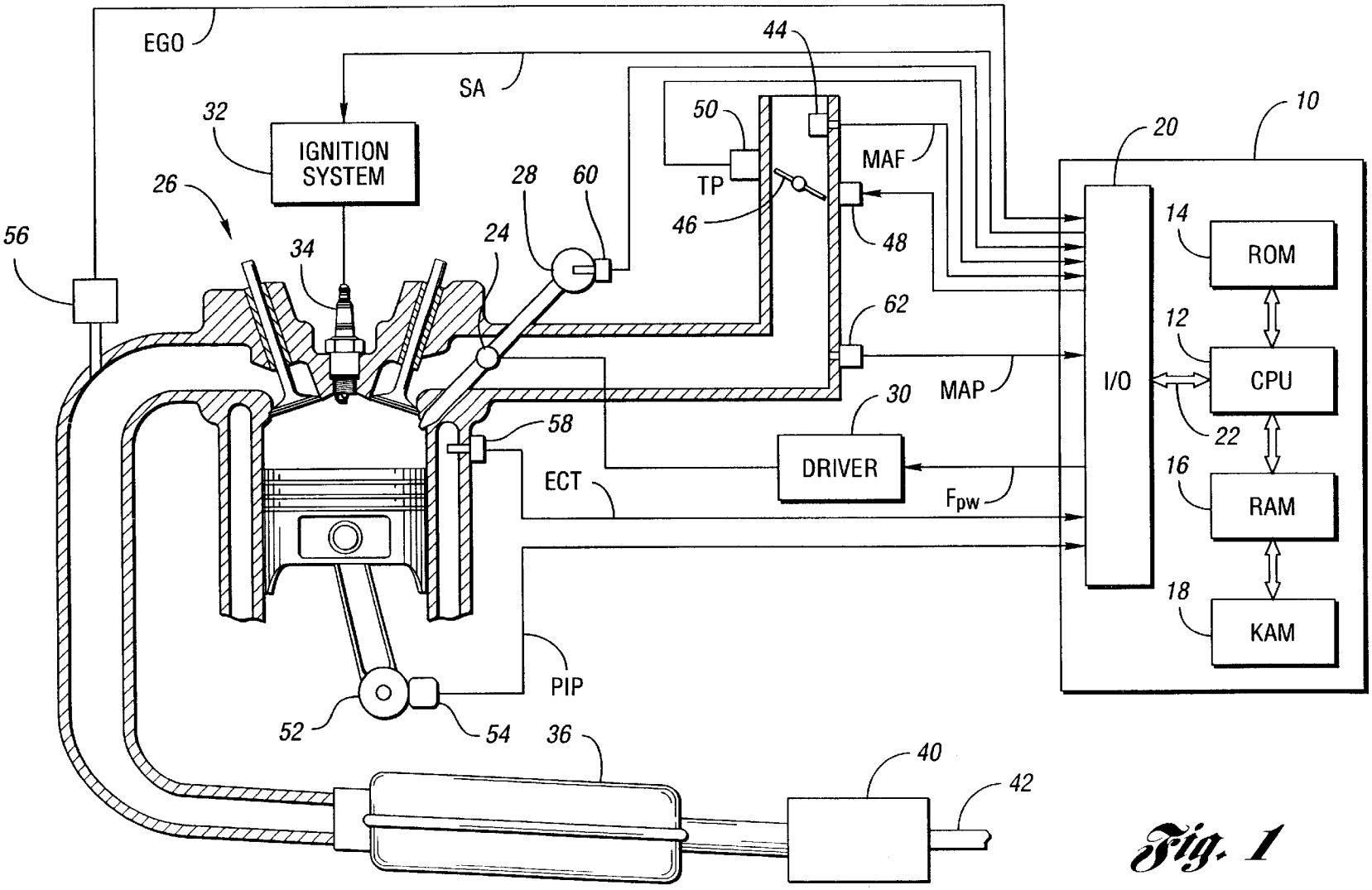
FIG. 1 is a block diagram of the system of the present invention.

Referring now to the drawings, and initially to FIG. 1, a schematic block diagram of an engine control system for carrying out the method of the present invention is shown. An electronic engine controller 10 comprises a microcomputer including a central processor unit (CPU) 12, read only memory (ROM) 14 for storing control programs, random access memory (RAM) 16, for temporary data storage which may also be used for counters or timers, such as an Engine Run Timer, and keep-alive memory (KAM) 18 for storing learned values. Data is input and output over I/O ports generally indicated at 20, and communicated internally over a conventional data bus generally indicated at 22.

The controller 10 controls one or more injectors, only one of which is shown and designated 24, which inject fuel respectively into one or more associated cylinders of a direct injection gasoline engine generally designated 26. The fuel injectors are of conventional design and inject fuel into their associated cylinder in precise quantities as determined and controlled by the controller 10 which operates on the basis of a program stored in ROM 14 for carrying out the method of the present invention. A conventional fuel delivery system including a fuel tank with a fuel pump located therein (not shown) supplies fuel to the fuel injectors by way of a fuel rail 28. The controller 10 is responsive to various engine operating conditions to provide a variable fuel pulse width control signal fpw, by way of a driver 30, to each injector to meet the fuel demand of the engine.

An ignition signal spark angle SA, is provided by the controller 10 to an ignition system 32 to command ignition of a spark plug 34 disposed in each engine cylinder.

An exhaust system transports exhaust gas produced from combustion of an air/fuel mixture in the engine to a conventional close coupled three way catalytic converter (TWC) 36. The converter 36, contains a catalyst material that chemically alters exhaust gas that is produced by the engine to generate a catalyzed exhaust gas. The catalyzed exhaust gas is fed through an exhaust pipe 38 to a downstream muffler 40 and thence to the atmosphere through a tailpipe 42.

An air meter or mass air flow (MAF) sensor 44 is positioned in the air intake manifold of the engine and provides a signal to the controller 10 indicative of the air mass flow into the manifold. Controller 10 operates an electronic throttle operator 48, which may comprise a torque motor, stepper motor, or other type of actuating device which throttles the airflow in response to driver demand information from an accelerator pedal position sensor (not shown). Position feedback of a throttle 46 may be provided to controller 10 by a sensor 50.

The crankshaft 52 of the engine 26 is operatively connected with a crank angle detector 54 which detects the rotational speed of the engine. A heated exhaust gas oxygen (HEGO) sensor 56 detects the oxygen content of the exhaust gas generated by the engine, and transmits a signal to the controller 10 to control engine AFR. A sensor 58 provides a signal to the controller 10 indicative of engine coolant temperature (ECT). A fuel pressure sensor 60 located in the fuel rail 28 provides a signal to the controller 10 indicative of fuel pressure. An intake manifold air pressure (MAP) sensor 62 detects the pressure in the manifold 14 and provides a signal to the controller 10. The sensor 62 may be a variable capacitor type that provides an output whose frequency is indicative of MAP such as, for example, a silicon capacitive absolute pressure (SCAP) sensor. As is well known in the art, a variable frequency signal may be converted to a voltage and compared with a sawtooth signal to produce an output signal having a pulse width that is related to the frequency and thus to manifold absolute pressure is a SCAP sensor is used. Still other sensors, well know in the art, may provide additional information about engine performance to the controller 10, such as engine position; angular velocity, throttle position, air temperature, etc. The information from these sensors is used by the controller 10 to control engine operation.

The calculations for the required MAP transfer function are as follows with reference to FIGS. 2*a*–2*d*. A line that intersects the x axis at a given point may be represented by the following equation.

$$y_value=(rise/run)*(x_value-x_offset)$$

Figure 2A:
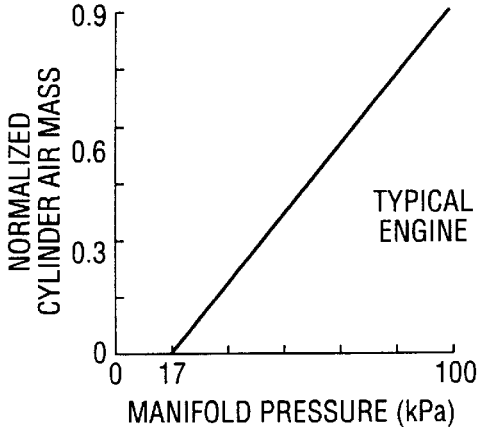
FIGS. 2*a*, 2*b*, 2*c* and 2*d* are charts depicting relationships that are useful in describing the invention.

FIG. 2*a* shows the relationship between normalized cylinder air mass and manifold pressure for a typical engine. For a typical engine the cylinder air charge may be calculated using the following equation:

$$norm_cyl_air_mass=(0.9/(100-17))*(man_press-17)$$

where:

100=normalizing pressure

17=pressure offset.

Figure 2B:
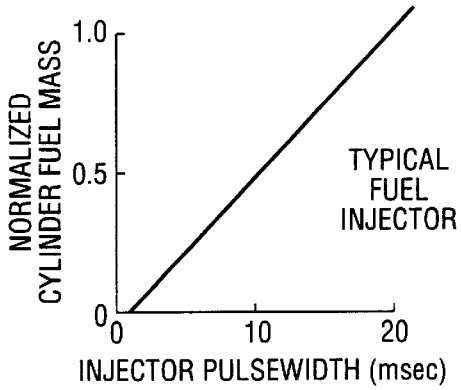

FIG. 2*b* shows the relationship between normalized cylinder fuel mass and injector pulse width for a typical fuel injector. For a typical injector the cylinder fuel mass may be calculated using the equation:

$$norm_cyl_fuel_mass=(1/(20-1))*(inj_pw-1)$$

where:

20=injector pulse width required to supply a cylinder with a normalized fuel of 1; and 1=injector pulse width offset=normalized cylinder air mass at normalizing pressure.

For the most common case where one chooses to fuel with a stoichiometric ratio of fuel and air, set the air charge and fuel mass equal:

$$(0.9/(100-17))*(man_press-17)=(1/(20-1))*(inj_pw-1)$$

Rearranging:

$$(inj_pw-1)=(0.9/(100-17))*(man_press-17)/(1/(20-1))$$

Solving for inj_pw:

$$inj_pw=(((0.9/(100-17))*(man_press-17)/(1/(20-1)))+1$$

Simplifying:

$$inj_pw=((0.9/(100-17))/(1/(20-1))*(man_press-17)+1$$

Further Simplifying:

$$inj_pw=((0.9*(20-1)/(100-17)*(man_press-17)+1$$

Figure 2C:
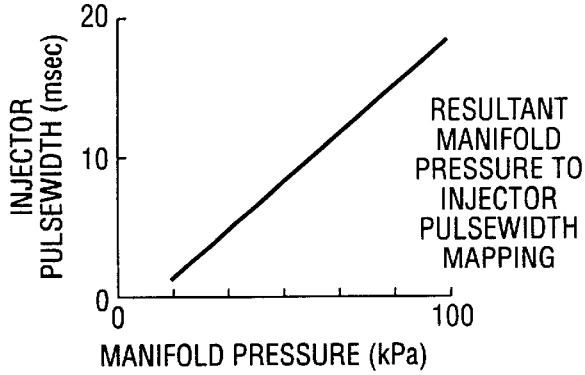
Figure 2D:
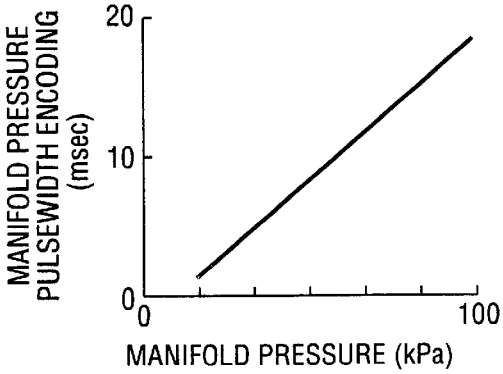

This solution for a particular injector pulse width to manifold pressure mapping is shown in FIG. 2*c*. If this is used as the MAP pulse width mapping as shown in FIG. 2*d*, the desired effect of no clock sensitivity is attained. Further injector pulse width (for stoichiometry) exactly equals MAP pulse width. If a faster MAP data rate is desired this mapping could be scaled as follows: Set the manifold pressure period equal to a fraction of the injector pulse width, for example:

$$man_press_period=inj_pw/10$$

$$man_press_period=(((0.9*(20-1)/(100-17)*(man_press-17)+1)/10$$

where:

10=the scaling factor between inj_pw and man_press_period.

Any error is minimized because of two effects that generally oppose each other. The first effect is the affine relation between cylinder air mass (mass of air ingested into cylinder) and MAP. Note in FIG. 2*a* that the affine line between cylinder air mass and MAP intersects the MAP axis at about 17 kilopascals. The second effect is the affine relationship between fuel mass injected and fuel injector driver on-time. Note in FIG. 2*b* that the affine line between fuel mass injected and fuel injector driver on-time intersects the fuel injector driver on-time axis at approximately 0.5 milliseconds.

Both of these relations can be shaped by design actions. For example, the fuel mass injected versus fuel injector on-time can be shaped by changing the value of the zener diode that limits the reverse voltage imposed by a closing injector. It is also altered by the use of a fold-back injector driver where the opening current is much greater than the holding current. The engine characteristic is one that would not generally change but is changeable by the intake and exhaust valve timing (i.e., camshaft configuration). Clearly, one could shape them to exactly oppose each other. However, should this not be desirable for some other reason, one can make the effects cancel each other by shaping the MAP versus pulse width affine relation. The task of the micro controller becomes exceedingly simple for systems where only a basic fuel controller is required such as a lawn mower, chain saw, motor scooter, outboard boat motor, and the like. The MAP sensor itself is putting out an "up-time" pulse and the fuel injector requires an on-time pulse. With the previously described inventive features in place to make the timing source of little impact on accuracy, one can see that if the MAP sensor is providing a pulse and the fuel injector requires a pulse, by synchronizing these two pulses the task of the microcontroller could be eliminated.

To synchronize these pulses, an engine position signal is fed to the MAP sensor and the sensor issues its MAP information during the appropriate time in the engine cycle. For a direct-injected engine, this is generally during the compression stroke; for port fuel-injected engines this is usually on a "closed intake valve"; and for manifold-injected engines, synchronization is not required. For example, in a port fuel-injected engine system an engine signal would trigger the MAP sensor to send out its MAP data as a pulse at the beginning of the power-stroke (in the case of a four-stroke cycle). A two-millisecond pulse might correspond to an idle condition (35 kPa of MAP) and a 20 millisecond pulse might correspond to a WOT condition (95 kPa of MAP). In this way, the MAP sensor would directly issue its data in a way such that no intervening calculations are required.

By providing a direct connection between the MAP sensor and injector, the usual intervening microcontroller can be eliminated. This simple system is sufficient and cost-effective for many small engine applications such as those mentioned above.

Figure 3:
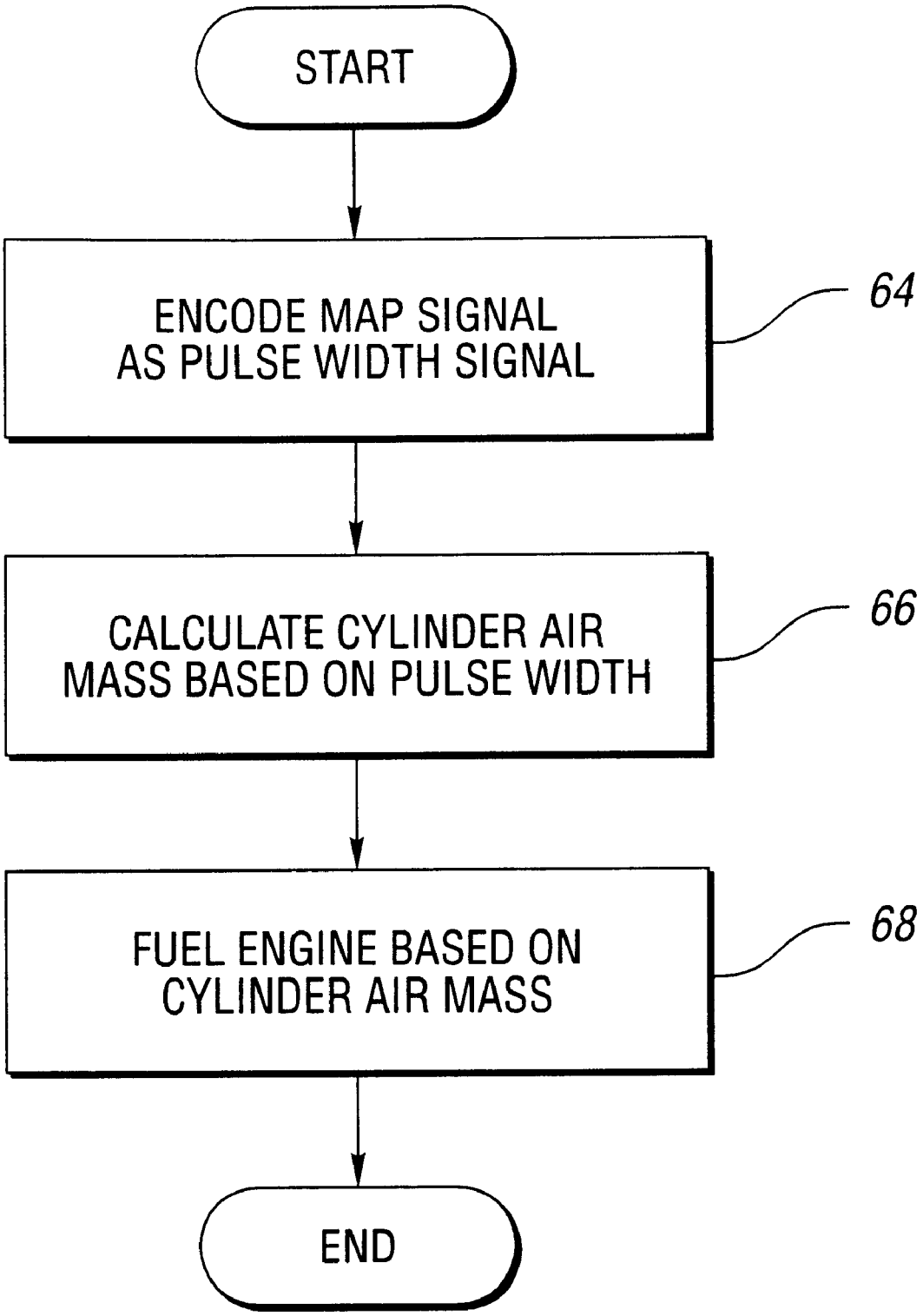
FIG. 3 is a flowchart depicting the method of the present invention.

Referring now to FIG. 3 a flowchart of the method of the present invention is shown. Initially, as indicated in block 64, the MAP sensor signal is encoded as a pulse width signal. The cylinder air mass is then calculated based on the pulse width of the encoded signal as indicated in block 66. The engine is then fueled based the calculated cylinder air mass as indicated at block 68.

While the best mode for carrying out the invention has been described in detail, those familiar with the art to which this invention relates will recognize various alternative designs and embodiments for practicing the invention as defined by the following claims.

What is claimed is:

1. A system for controlling fuel to an engine having a manifold absolute pressure (MAP) sensor, comprising:

means for encoding a signal from said MAP sensor as a pulse width signal;

means for calculating cylinder air mass as a function of said pulse width signal; and means for fueling the engine according to the calculated cylinder air mass where the fueling of the engine is accomplished by applying an injection signal to a fuel injector and the injection signal has a pulse width that is related to the MAP sensor encoded output pulse width.

2. The system of claim 1 wherein said MAP sensor produces a signal output having a period that is indicative of pressure.

3. The system of claim 1 where the fueling of the engine is accomplished by applying an injection signal to a fuel injector and the injection signal has a pulse width that is substantially identical to the MAP sensor encoded output pulse width.

4. The system of claim 3 wherein the engine is a direct injected engine, an engine position signal is fed to the MAP sensor, and the sensor issues its MAP information during the compression stroke time in the engine cycle.

5. The system of claim 3 wherein the engine is a port fuel-injected engine, an engine position signal is fed to the MAP sensor, and the sensor issues its MAP information at the beginning of a power stroke.

6. The system of claim 3 wherein the engine is a port fuel-injected engine, an engine position signal is fed to the MAP sensor, and the sensor issues its MAP information during a closed intake valve.

7. An article of manufacture comprising:

a computer storage medium having a computer program encoded therein for controlling fuel to an engine having a manifold absolute pressure (MAP) sensor, said computer storage medium comprising:

code for encoding a signal from said MAP sensor as a pulse width signal;

code for calculating cylinder air mass as a function of said pulse width signal;

code for fueling the engine according to the calculated cylinder air mass; and code for applying an injection signal to a fuel injector for fueling of the engine, where the injection signal has a pulse width that is related to the MAP sensor encoded output pulse width.

8. The article of claim 7 where the injection signal has a pulse width that is substantially identical to the MAP sensor encoded output pulse width.

9. The method of claim 8 wherein the engine is a direct injected engine, and the code for calculating cylinder air mass is determined from MAP sensor information obtained during the compression stroke time in the engine cycle.

10. A method of controlling fuel to an engine having a manifold absolute pressure (MAP) sensor, said method comprising a sequence of the following steps:

encoding a signal from said MAP sensor as a pulse-width signal;

calculating cylinder air mass as a function of said pulse width signal; and fueling the engine according to the calculated cylinder air mass where the fueling of the engine is accomplished by applying an injection signal to a fuel injector and the injection signal has a pulse width that is related to the MAP sensor encoded output pulse width.

11. The method of claim 10 wherein said MAP sensor produces a signal output having a period that is indicative of pressure.

12. A method of controlling fuel to an engine having a manifold absolute pressure (MAP) sensor, said method comprising a sequence of the following steps:

encoding a signal from said MAP sensor as a pulse width signal;

calculating cylinder air mass as a function of said pulse width signal; and fueling the engine according to the calculated cylinder air mass where the fueling of the engine is accomplished by applying an injection signal to a fuel injector and the injection signal has a pulse width that is substantially identical to the MAP sensor encoded output pulse width.

13. The method of claim 12 wherein the engine is a direct injected engine, and the calculation of cylinder air mass is determined from MAP sensor information obtained during the compression stroke time in the engine cycle.

14. The method of claim 12 wherein the engine is a port fuel-injected engine, and the calculation of cylinder air mass is determined from MAP sensor information obtained during the compression stroke time in the engine cycle.

15. The method of claim 12 wherein the engine is a port fuel-injected engine, and the calculation of cylinder air mass is determined from MAP sensor information obtained during a closed intake valve.

* * * * *